United States Patent [19]

Maroszek et al.

[11] 4,375,482

[45] Mar. 1, 1983

[54] PACKAGE INCLUDING PRODUCT SUPPORT INSERT

[75] Inventors: Raymond V. Maroszek; Walter J. Oppermann, both of Neenah, Wis.

[73] Assignee: James River-Dixie/Northern, Inc., Greenwich, Conn.

[21] Appl. No.: 174,553

[22] Filed: Aug. 1, 1980

[51] Int. Cl.[3] ..... B65D 85/62; B65D 81/20; B65D 77/24; B65D 75/38

[52] U.S. Cl. ..... 426/124; 229/87 F; 426/121

[58] Field of Search ..... 426/124, 129, 121; 229/87 F, 40, 8

[56] References Cited

U.S. PATENT DOCUMENTS

| | | | |
|---|---|---|---|
| 76,830 | 4/1868 | Scudder | 229/21 |
| D. 235,974 | 7/1975 | Seiferth et al. | D9/99 |
| D. 250,173 | 11/1978 | Hovland | D9/99 |
| 396,028 | 1/1889 | Colhapp | 229/21 |
| 397,475 | 2/1889 | Tiffany | 229/8 |
| 1,916,519 | 7/1933 | Madsen et al. | 229/21 |
| 2,804,258 | 8/1957 | Petter | 229/87 F |
| 2,878,985 | 3/1959 | Rossum | 229/87 F |
| 2,919,846 | 1/1960 | Allen | 229/87 F |
| 2,929,724 | 3/1960 | Farrell | 426/121 |
| 2,940,655 | 6/1960 | Dunning | 229/87 F |
| 2,963,215 | 12/1960 | Saidel et al. | 426/121 |
| 2,964,227 | 12/1960 | Goldsholl | 229/21 |
| 2,965,283 | 12/1960 | Dunning | 229/87 F |
| 2,966,293 | 12/1960 | Goldsholl | 229/8 |
| 2,978,165 | 4/1961 | Bolding | 229/87 F |
| 2,996,236 | 8/1961 | Barr | 426/121 |
| 3,010,571 | 11/1961 | Transport | 229/8 |
| 3,100,597 | 8/1963 | Saidel et al. | 229/87 F |
| 3,100,598 | 8/1963 | Saidel et al. | 229/87 F |
| 3,122,301 | 2/1964 | Barr | 229/87 F |
| 3,126,145 | 3/1964 | Struble | 229/8 |
| 3,343,743 | 9/1967 | Hamilton et al. | 229/8 |
| 3,381,885 | 5/1968 | Seiferth et al. | 229/8 |
| 3,703,384 | 11/1972 | Seiferth | 426/121 |
| 3,803,332 | 4/1974 | Seiferth et al. | 426/121 |
| 3,929,222 | 12/1975 | Smith et al. | 229/8 |
| 3,978,260 | 8/1976 | Dobbins et al. | 426/121 |
| 4,124,160 | 1/1978 | Meyers et al. | 229/8 |
| 4,210,240 | 7/1980 | Fricano | 206/45.31 |

FOREIGN PATENT DOCUMENTS

| | | | |
|---|---|---|---|
| 1341926 | 9/1962 | France | 229/8 |

*Primary Examiner*—Steven L. Weinstein

*Attorney, Agent, or Firm*—William A. Aguele; Harry W. Hargis, III; Joseph J. Brindisi

[57] ABSTRACT

An improved bacon package is disclosed. The stiffening packaging element, commonly known as a bacon board, has full width top and bottom panels which support the bacon from the bottom and cover it over the entire top. Cover flaps on the ends of the top panel are defined by lines of weak bending resistance, and function to cover the ends of the array of bacon when the packaging element and bacon are enclosed in plastic films in a vacuum packaging operation.

13 Claims, 10 Drawing Figures

PACKAGE INCLUDING PRODUCT SUPPORT INSERT

BACKGROUND OF THE INVENTION

In the packaging of sliced meat products, such as bacon or the like, it has become common practice to support the slices in a shingled array on a stiffening packaging element. In the subsequent process of vacuum sealing, the packaging element and product are enclosed in plastic films, the entire package is evacuated by a vacuum means, and the films are heat sealed together to close the package. In the finished package, commonly referred to as a vacuum package, the plastic films conform to the combination of the stiffening packaging element and the shingled array of product. Typical packages and packaging elements in the prior art are shown by the following U.S. design and utility patents:

U.S. Pat. No. Des. 235,974
U.S. Pat. No. Des. 250,173
U.S. Pat. No. 2,929,724
U.S. Pat. No. 2,963,215
U.S. Pat. No. 2,965,283
U.S. Pat. No. 3,100,597
U.S. Pat. No. 3,100,598
U.S. Pat. No. 3,703,384
U.S. Pat. No. 3,803,332
U.S. Pat. No. 3,978,260

Conventional stiffening packaging elements are of two general types. In the first type, the packaging element has a full size supporting bottom panel and a substantially smaller top retaining panel. This type is illustrated in FIGS. 1, 3, and 5 of the above cited U.S. Pat. No. 3,803,332. The second type of packaging element has both a full size supporting bottom panel and a full size retaining top panel.

This invention is a new stiffening packaging element of the second type, having both a full size supporting bottom panel and a full size retaining top panel.

SUMMARY OF THE INVENTION

In brief, the invention is a stiffening packaging element adapted to support and retain sliced product in a shingled array, the element having a supporting panel and a retaining panel. The supporting and retaining panels each are generally rectangular, having two longer sides and side edges defining the length of each panel and two shorter ends and end edges defining the width of each panel. The two panels are joined together by a hinge line along common side edges, such that the retaining panel may be rotated about the hinge line and over the supporting panel to overlie and substantially cover the supporting panel. The retaining panel has, on each of its ends, a substantially continuous transverse line of weak bending resistance extending from the vicinity of the intersections of the common side edge and the end edges, inwardly of the end edges, across the width of the retaining panel, to the adjoining intersection of the same respective end edges and the opposite side edge. The transverse lines of weak bending resistance and their respective end edges define cover flaps on the ends of the retaining panel. The supporting panel has sides and ends corresponding to the sides and ends of the retaining panel respectively when the retaining panel overlies the supporting panel. The ends of the supporting panel are devoid of lines of weak bending resistance corresponding to the lines of weak bending resistance on the ends of the retaining panel.

In preferred embodiments, each of the transverse lines of weak bending resistance is a continuous arc having a constant center of curvature.

In certain of the preferred embodiments, each end of the retaining panel has cuts extending inwardly of the cover flaps from the corresponding end edge. The cuts may extend to the line of weak bending resistance. The cuts may be cut lines. In especially preferred embodiments, the cuts are equally spaced from each other and extend in a direction parallel to the hinge line, and the lines of weak bending resistance are formed by cut scores, the cut scores in the lines of weak bending resistance being discontinuous at the intersections of the lines of weak bending resistance with the cuts.

DETAILED DESCRIPTION OF THE ILLUSTRATED EMBODIMENT

Figure 1:
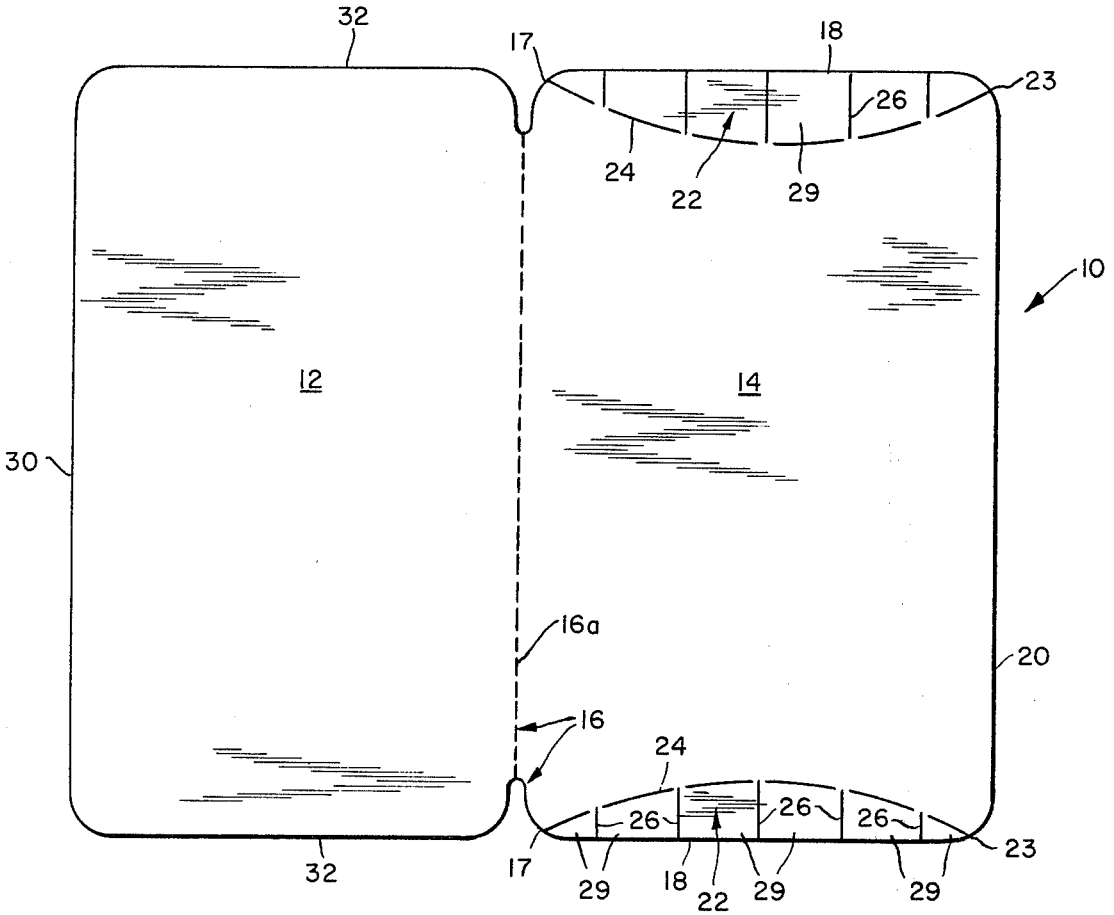
FIG. 1 is the plan view of a blank of the packaging element of this invention.

The packaging element of this invention is generally designated as 10 in FIG. 1, and is composed of supporting panel 12 and retaining panel 14. Supporting and retaining panels 12 and 14 respectively are generally rectangular, each having two longer sides generally identified with corresponding side edges and two shorter ends generally identified with corresponding end edges. Supporting and retaining panels 12 and 14 are joined together along their common side edges 16 such that side edges 16 form a fold line 16*a*.

Each end of retaining panel 14 has a cover flap 22, bounded on its periphery by a combination of transverse line of weak bending resistance 24 and end edge 18. The combination of cut lines 26, which extend from line 24 to edge 18, and transverse line of weak bending resistance 24 defines cover flap segments 29, which extend from line of weak bending resistance 24 to the end edge 18 of retaining panel 14, and consequently, by definition, to the free edge of cover flap 22.

Lines of weak bending resistance 24 extend in a continuous arc on retaining panel 14 from the vicinity of points 17 identified by the intersection of side edge 16 with end edges 18, inwardly of the end edges, across the width of retaining panel 14, to points 23 at the adjoining intersections of the respective ones of end edges 18 with side edge 20. Lines 24, as shown, are made weaker than the surrounding paperboard by means of a cut score on the line 24. The cut score is discontinuous at the intersections of line 24 with cut lines 26. It should be appreciated that, while the cut score is discontinuous at cut lines 26, line of weak bending resistance 24, which is formed by the cut score, is functionally continuous as a line of weak bending resistance because of the short length of the discontinuities of the cut score. The full thickness of paperboard at the discontinuities provides point-located strength which is sufficient to resist tearing forces and to retain cover flap segments 29 on the packaging element 10 as the package is being processed. Concurrently, the length of the discontinuities is sufficiently short that it is ineffective in resisting bending forces operating to bend the end flaps 22 about lines of weak bending resistance 24.

Lines of weak bending resistance 24 have been described as being formed by cut scores having discontinuities. In the accommodation of various end uses, and packaging and handling operations, the lines of weak bending resistance may be formed by any of a variety of techniques rendering the lines 24 weak to bending resistance relative to the rest of the packaging element. Thus, a line 24 may be formed by a continuous cut score. It may also be formed by a crease score, or by perforations.

As described above, edge 20 extends from point 23 on one end of panel 14 to point 23 on the other end of the panel. Line 16, which includes fold line 16*a*, extends from point 17 on one end of panel 14 to point 17 on the other end of the panel. Thus, it is clear that edges 16 and 20 include a substantial portion of the rounded corners. Panel 12 has a side edge 30 remote from common side edge 16 and corresponding to edge 20 of panel 14 when panel 14 overlies panel 12. End edges 32 on panel 12 similarly correspond to end edges 18 on panel 14.

Figure 2:
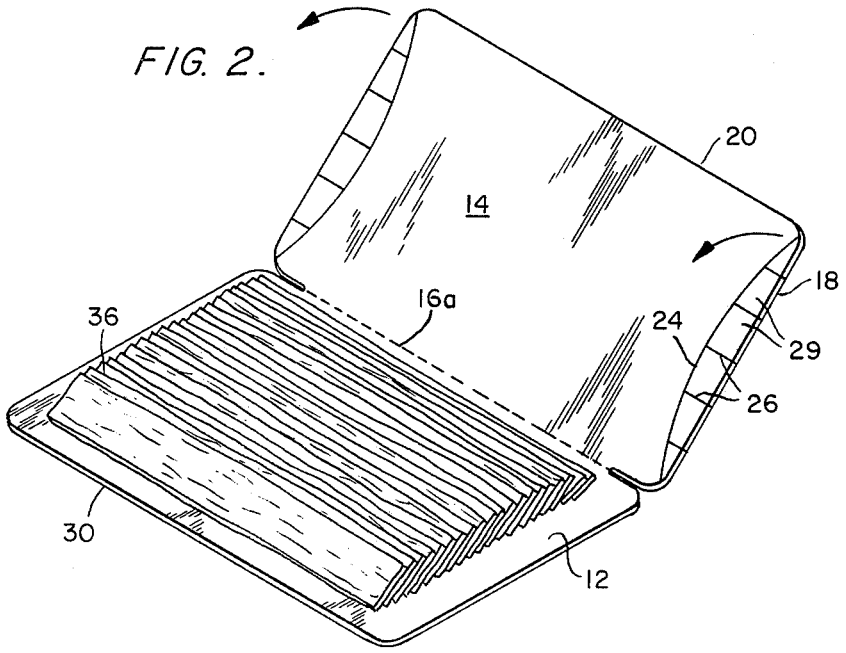
FIG. 2 is a perspective view of a partial package assembly including the packaging element of FIG. 1 and an array of product on the supporting panel.
Figure 3:
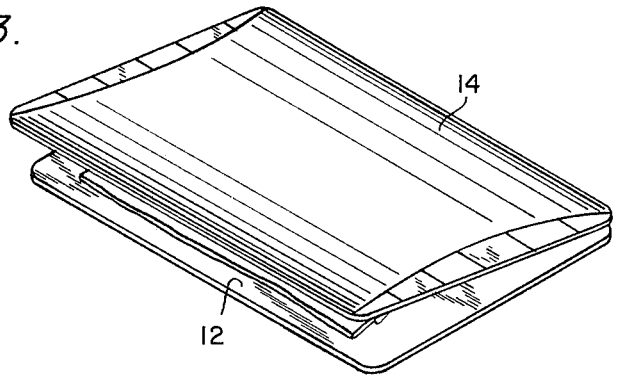
FIG. 3 shows the partial assembly with the retaining panel folded loosely over the supporting panel and the product, ready for the vacuum sealing operation.

The invention is herein described as it is used with sliced bacon. Skilled artisans appreciate that it can be used for a variety of products. In FIG. 2, the packaging element 10 has sliced bacon 36 arranged on the supporting panel. The arrows leading from the retaining panel indicate movement of that panel to close the package and prepare it for the vacuum sealing operation, where it is sealed in plastic films. FIG. 3 shows the package with retaining panel 14 folded over the supporting panel 12 and the bacon 36, ready for evacuation and sealing. The amount of curvature of panel 14 and the degree to which it conforms to the bacon 36, as in FIG. 3, is somewhat dependent on the stiffness of the material used. In the embodiment shown, the material is wax-coated paperboard which has a thickness of about 0.010 inch, and which is a common material for use with package supporting and stiffening elements.

The package shown in FIG. 3 is then vacuum sealed in plastic film in a conventional vacuum sealing operation, described further hereinafter.

Figure 4:
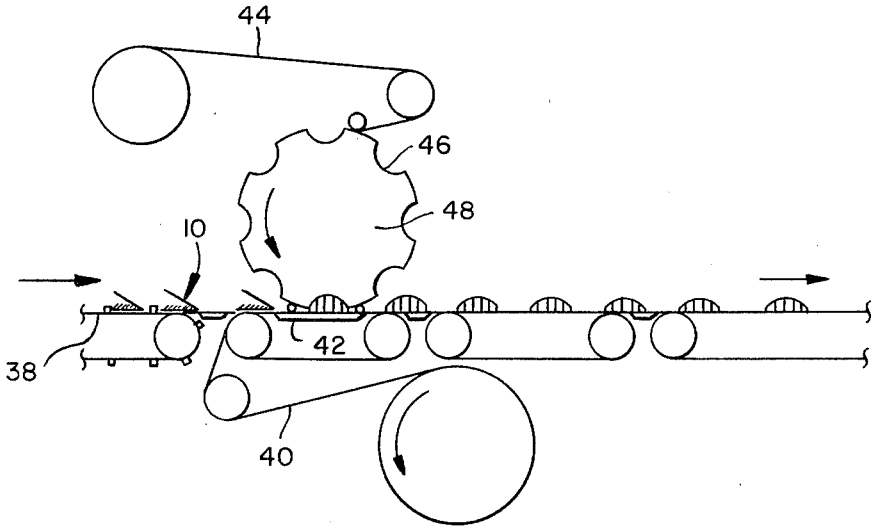
FIG. 4 shows a general arrangement of machinery which may be used with the packaging element of this invention.
Figure 5:
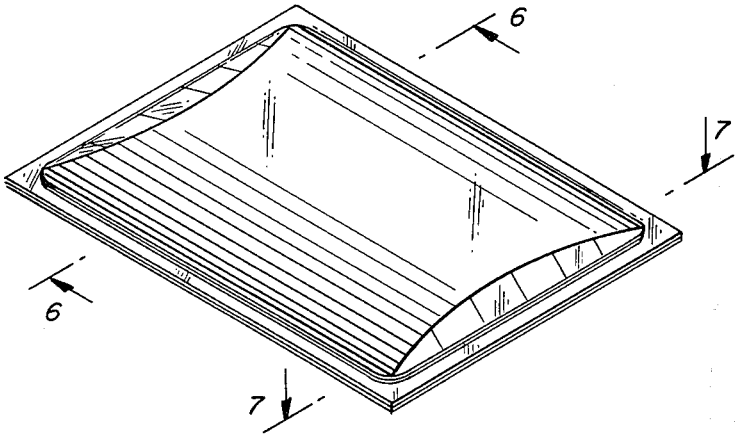
FIG. 5 shows the completed package after the vacuum sealing operation.
Figure 6:
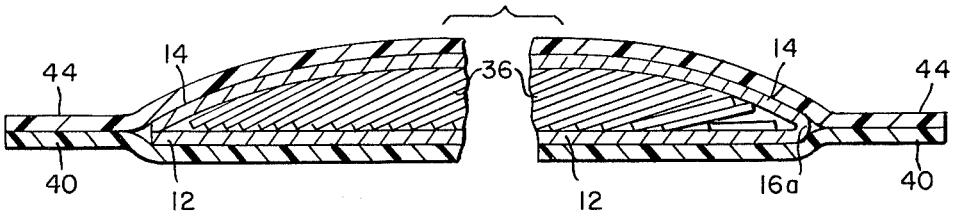
FIG. 6 is a partial view of a cross-section of the package, taken at 6—6 in FIG. 5.
Figure 7:
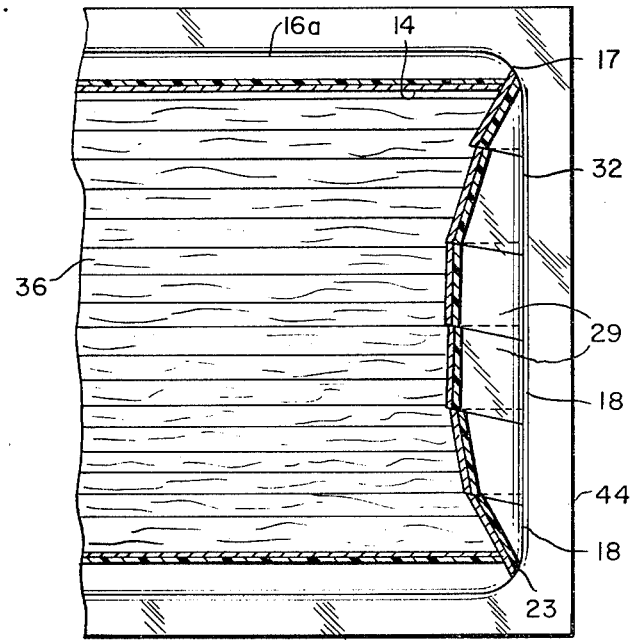
FIG. 7 is a partial view of a cross-section of the package taken at 7—7 in FIG. 5.

The best mode contemplated for making a package filled with product using the packaging element of the invention is to use it in combination with conventional packaging machinery such as that outlined in FIG. 4. A package sub-assembly, including packaging element 10 and bacon 36, is fed by an incoming conveyor 38 onto a continuous length of non-forming plastic film 40 which is supported by a rigid member 42. Non-forming plastic film is a relative term which means a film whose physical properties resist plastic deformation under the conditions it encounters in the vacuum sealing operation. A portion of a continuous length of a second film 44, which is a forming film, is introduced into a vacuum forming die 46 on a rotating drum 48. Die 46 forms the above mentioned portion of film 44 into a pocket by conventional means of heat and vacuum. Rotation of drum 48 is synchronized with incoming conveyor 38, so that the formed pocket on film 44, which will form the top film on the package, rotates into position over the package sub-assembly as the sub-assembly moves directly under drum 48. Thus the sub-assembly and the formed portion of the top film are brought together with the surfaces of films 40 and 44 facing each other around the periphery of the package sub-assembly. Conventional heat seal bars form seals along the side edges, and along the major portions of the end edges, of the package. The films in this first package are left unsealed along a portion of each end edge of the package. The package is then moved to the next work station as drum 48 rotates the next pocket on film 44 over the next package sub-assembly. Vacuum devices are inserted into the first package through the unsealed portions of each end edge and the package is evacuated. The vacuum devices are then removed and the unsealed portion of each end edge is immediately closed and sealed by a second set of heat seal bars. As the air is removed from the package during the evacuation process, the external atmospheric air pressure exerts inwardly directed force uniformly against the entire surface of the exterior of the package. Top film 44 collapses inwardly, with a uniform pressure, against the paperboard of panel 14 and against bottom film 40. Overall, the effective function of film 44, in the vacuum sealing operation, is that of transmitting the external air pressure to panel 14 uniformly across its surface. Panel 14 responds to the pressure by collapsing against the shingled array of bacon. As panel 14 collapses, side edge 20 comes into contact with panel 12 near its edge 30, creating a substantial arcuate surface in panel 14 as best seen in FIGS. 4, 5 and 6. Cover flaps 22 substantially simultaneously respond to the uniform force by rotating about lines 24 and moving downwardly against supporting panel 12. As cover flap segments 29 rotate downwardly about line 24 from the arcuate surface of panel 14, they overlap each other toward their outer edges 18, as seen in FIG. 7. Desirably, the outer edges of segments 29, at 18, meet panel 12, and form a complete end closure on the package, generally serving to protect the product from exposure to light. Thus, minor horizontal wrinkling of segments 28, which may be indicative of a slight excess of material on panel 14, is entirely satisfactory, and is, in some cases, encouraged, to ensure complete closure of the package against substantial infiltration of light.

In the thus formed and sealed package, the top film 44 conforms to panel 14 and holds panel 14 against the product on the top, and on the ends. As a result of the evacuation process, film 40 conforms to panel 12. The two films 40 and 44, thus form a unitary film enclosure conforming to element 10 and forcing it to conform closely to the arrayed product. The formed package has the excess film trimmed off and is then complete, as shown in FIG. 5. FIG. 7 shows the overlapping relationships of the various cover flap segments 29 relative to each other in the finished package.

Cut lines 26 may be designed with a substantial amount of freedom—and, in some embodiments, cut lines 26 may be eliminated in favor of alternate structure.

Figure 8:
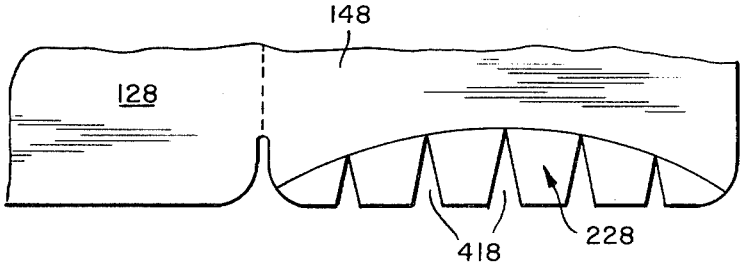
FIGS. 8, 9, and 10 are partial plan views of alternate versions of the blank shown in FIG. 1.

In another embodiment illustrated in FIG. 8, sections of the cover flap 228 may be removed, such as at 418. In this embodiment, the edges of the adjoining flap segments may abut each other when the package is vacuum sealed, rather than overlapping as in FIG. 7.

Figure 9:
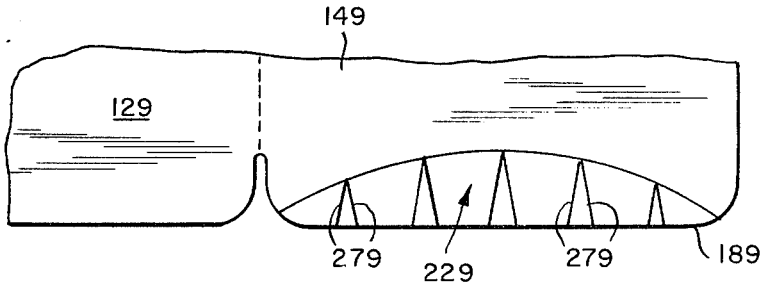

In still another embodiment illustrated in FIG. 9, cut lines 26, such as are shown in FIG. 1, have been replaced by pairs of fold lines 279. Each pair of lines 279 extends in converging relationship from edge 189 to line 249. When the vacuum is drawn, as described for FIG. 4, the cover flaps bend about line 249 and fold about the fold lines 279 providing overlapping relationships similar to those shown in FIG. 7.

Figure 10:
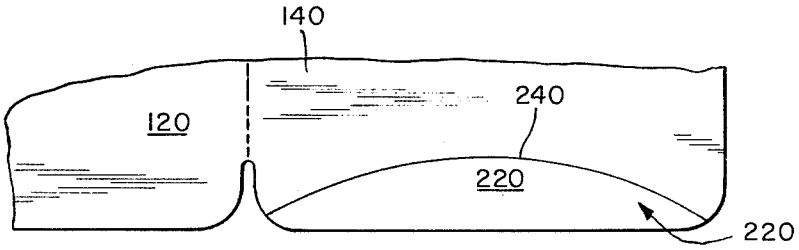

In all the embodiments discussed in detail so far, provision has been made in the cover flaps for having the cover flaps in general conformity to the final contour of the ends of the array of bacon in the finished vacuum package. This is accomplished in the FIG. 1 embodiment by cut lines 26. It is accomplished in the FIG. 8 embodiment by removal of material at 418. In the FIG. 9 embodiment, pairs of fold lines 279 provide the capability for the cover flaps to fold and conform. In all these embodiments, the mechanism for conformity, whether cut lines, cuts, or fold lines, has been illustrated as extending from the outer free edge of the cover flaps to the corresponding line of weak bending resistance. While these, and similar configurations, are preferred, the invention contemplates, and includes mechanisms for conformity which differ substantially from those illustrated. Thus, in the simplest embodiment, illustrated in FIG. 10, cover flap 220 is devoid of cuts and fold lines. Similarly, other configurations of cuts and fold lines, and combinations thereof, may be employed advantageously in the cover flaps in the practice of the invention.

Thus it is seen that this invention provides an improved internal package stiffening element for use with an array of sliced product, wherein the top of the product is covered by a top retaining panel of the packaging element. The packaging element has been described as it cooperates and is used, with the other elements of the package, and with the packaging machinery. While the description broadly incorporates these other elements and the machinery, it is not intended that the invention be limited to such incorporations. Rather the invention is to be limited only by the scope of the appended claims.

Having thus described the invention, what is claimed is:

1. A stiffening packaging element made from sheet material and adapted to support and retain a sliced product in a shingled array, and facilitating substantially smooth disposition thereabout of a plastic film and subsequent sealing thereof to enclose said element and said product, said element comprising:

a supporting panel and a retaining panel, said supporting and retaining panels each being generally rectangular, having two longer sides and side edges defining the length of each panel and two shorter ends and end edges defining the width of each panel, and being joined together by a hinge line along common side edges, such that said retaining panel may be rotated about said hinge line and over said supporting panel to overlie and substantially cover said supporting panel;

said retaining panel having, on each end thereof, a substantially continuous arcuate line of weak bending resistance extending from the vicinity of the intersections of said common side edge and said end edges, inwardly of said end edges, across the width of said retaining panel, to the adjoining intersection of the same respective end edges and the opposite side edge, said arcuate lines of weak bending resistance and their respective end edges defining segmentary cover flaps on the ends of said retaining panel; and said supporting panel having sides and ends corresponding to the sides and ends of said retaining panel, respectively, when said retaining panel overlies said supporting panel, and each said segmentary cover flap being bendable about said lines of weak bending resistance to engage the corresponding end of said retaining panel with the corresponding end of said supporting panel, said ends of said supporting panel being devoid of lines of weak bending resistance corresponding to said lines of weak bending resistance on said ends of said retaining panel, wherein disposition of a plastic film wrapped about said packaging element and its supported and retained sliced product and subjection of the film wrapped element and product to evacuation under vacuum and a sealing force effective to urge said panels against said product and to collapse said segmentary cover flaps against said product and the corresponding ends of said supporting panel to provide a substantially smooth surface of the collapsed segmentary cover flaps over which surface the plastic film conforms.

2. A packaging element as in claim 1 wherein said lines of weak bending resistance are formed by cut scores.

3. A packaging element as in claim 2, each said end of said retaining panel having cuts extending inwardly on said cover flaps from the corresponding one of said end edges.

4. A packaging element as in claim 3 wherein said cuts are cut lines.

5. A packaging element as in claim 2, each said end of said retaining panel having cuts extending inwardly on said cover flaps from the corresponding one of said end edges.

6. A packaging element as in claim 3, 4, or 5 wherein said cuts extend to said line of weak bending resistance.

7. A packaging element as in claim 5 wherein said cuts are equally spaced from each other and extend in a direction parallel to said hinge line, and wherein said cut scores in said lines of weak bending resistance are discontinuous at the intersections of said line of weak bending resistance and said cuts.

8. A packaging element as in claim 5 wherein said cuts are cut lines.

9. A packaging element as in claim 7 wherein said cuts are cut lines.

10. A packaging element as in claim 1, said cover flaps having pairs of fold lines, each pair extending, in converging relationship, from one of said end edges inwardly on the corresponding one of said cover flaps.

11. The packaging element of claim 1 including means to facilitate the lateral contraction of at least a portion of said segmentary cover flaps during their collapse against the product during evacuation.

12. A filled and vacuum sealed package comprising:

a stiffening packaging element having a supporting panel and a retaining panel;

a sliced product in shingled array on said supporting panel and covered by said retaining panel;

and an enclosing film conforming to said package stiffening element and forcing said element to conform closely to said product;

said supporting and retaining panels on said packaging element each being generally rectangular, having two longer sides and side edges defining the length of each panel and two shorter ends and end edges defining the width of each panel, and being joined together by a hinge line along common side edges, such that said retaining panel overlies and covers said supporting panel and said product; and said retaining panel having on each end thereof, a substantially continuous arcuate line of weak bending resistance extending from the vicinity of the intersections of said common side edge and said end edges, inwardly of said end edges, across the width of said retaining panel, to the adjoining intersection of the same respective end edges and the opposite side edge, wherein portions of said retaining panel between said end edges and said lines of weak bending resistance are collapsed by said enclosing film into engagement with said sliced product upon vacuum sealing of the package to form a substantially smooth surface upon which the enclosing film conforms and the corresponding end edges of said supporting panel.

13. A package as in claim 12 wherein said supporting panel has sides and ends corresponding to the sides and ends of said retaining panel respectively, said ends of said supporting panel being devoid of lines of weak bending resistance corresponding to said lines of weak bending resistance on said ends of said retaining panel.

* * * * *